US008561333B2

(12) United States Patent
Meyers et al.

(10) Patent No.: US 8,561,333 B2
(45) Date of Patent: Oct. 22, 2013

(54) SNAP N PLACE SIGN SYSTEM AND METHOD OF USE FOR INTERIOR SIGNS

(76) Inventors: Roxanna Meyers, Albuquerque, NM (US); Wesley Meyer, San Francisco, CA (US); Leon Smith, Albuquerque, NM (US)

( * ) Notice: Subject to any disclaimer, the term of this patent is extended or adjusted under 35 U.S.C. 154(b) by 207 days.

(21) Appl. No.: 12/691,570

(22) Filed: Jan. 21, 2010

(65) Prior Publication Data

US 2010/0236118 A1 Sep. 23, 2010

Related U.S. Application Data

(60) Provisional application No. 61/146,267, filed on Jan. 21, 2009.

(51) Int. Cl.
*G09F 7/00* (2006.01)

(52) U.S. Cl.
USPC ..... 40/661; 40/611.1; 40/615; 40/663

(58) Field of Classification Search
USPC ..... 40/622, 737, 661, 611.01, 611, 673, 40/642.02, 663; 411/512, 508
See application file for complete search history.

(56) References Cited

U.S. PATENT DOCUMENTS

| | | | | | |
|---|---|---|---|---|---|
| 1,832,704 | A * | 11/1931 | Hausner | 40/737 |
| 2,894,426 | A * | 7/1959 | Rapata | 411/338 |
| 3,233,503 | A * | 2/1966 | Birger | 411/512 |
| 4,104,952 | A * | 8/1978 | Brass | 411/500 |
| 4,310,976 | A * | 1/1982 | Wilten | 40/737 |
| 6,197,164 | B1 * | 3/2001 | Pinarbasi | 204/192.11 |
| 6,470,612 | B1 * | 10/2002 | Pountney | 40/607.13 |
| 7,188,393 | B2 * | 3/2007 | Kawai | 24/297 |

* cited by examiner

*Primary Examiner* — Joanne Silbermann
*Assistant Examiner* — Christopher e Veraa

(57) ABSTRACT

A Snap N Place sign system and method for supporting a sign message includes a sign substrate associated with a number of rubber nipple fasteners and a lens. The sign message and the lens further include mounting holes placed at their corners for securely holding the sign message in association with the sign substrate and lens. The rubber nipple fastener can be pulled through the mounting holes in the lens utilizing a relatively low insertion force. The rubber nipple fasteners can be driven axially into the mounting holes in the lens with a flexible tab engaging the lens and flexing as they move through the hole in the lens. The rubber nipple fastener can be specifically designed such that the force required to install or push the rubber nipple fastener through the mounting hole is relatively low thereby facilitating ergonomic considerations. The Snap N Place sign system is capable of holding signs of a variety of thicknesses and sizes.

13 Claims, 5 Drawing Sheets

Figure 8

300

How to change the message in Your Snap N Place Sign System

We hope you find the Snap N Place sign system a fast, cost effective way to change the message in your signs. Your sign is designed to be changed without using any tools, so please never use anything but your fingers to remove and replace the lens as using a screwdriver or other tool will scratch the lens and could damage the rubber fasteners.

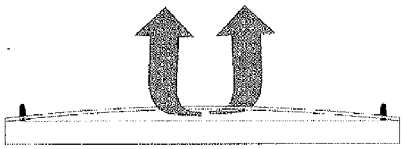

To remove the clear lens, start by gripping the middle of the lens on both sides with your index finger and thumb. Pull up gently.

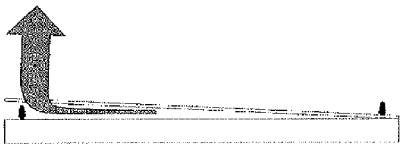

As the lens starts to flex, slide your fingers to one edge of the lens and pull up slightly when you get to the rubber fasteners. The lens will free itself. Repeat for the other side.

At this point you can change the transparent name insert. Install the message insert with the holes aligned with the rubber fasteners.

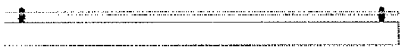

To replace the lens, align the four holes with the four rubber fasteners.

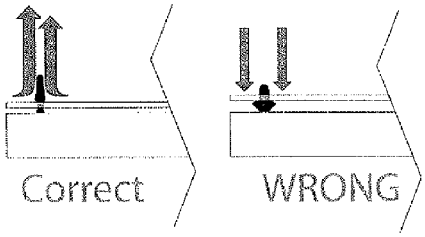

Pinch one of the rubber fasteners with your fingers and pull up until the fastener stretches slightly. While it is still stretched, push down on that edge of the lens and it will snap down into position.

DO NOT attempt to force the lens on by pressing it down on the rubber fastener. This may crack the lens.

Repeat attaching the lens to the remaining 3 rubber fasteners...done!

CENTURY SIGN BUILDERS | 505.888.2901 • tel
www.CSBsigns.com

SNAP N PLACE SIGN SYSTEM AND METHOD OF USE FOR INTERIOR SIGNS

INVENTION PRIORITY

This invention claims priority as a continuation application of U.S. Provisional patent application Ser. No. 61/146,267, filed Jan. 21, 2009 entitled "flexible sign holding and fastening system", which is herein incorporated by reference.

TECHNICAL FIELD

Features are generally related to interior room signs/nameplates and how they are updated or changed in a convenient, timely and low cost manner. Features are also related to fasteners for securing and supporting the sign lens to the substrate of the sign and holding in place a message.

BACKGROUND OF THE INVENTION

Historically in the interior sign industry, when an end-user needed to change the text or message on a room sign or nameplate, a new room sign/nameplate would need to be manufactured. Over the years, room signs and nameplate products have been developed that allowed the end-user to take the lens off a room sign/nameplate and change the message of the sign, however the removal of the lens required an additional "tool" such as a suction cup or "key" in order to remove the lens. Experience has proven that the "tool" or key" is typically lost or misplaced.

Based on the foregoing, it is believed that a need exists for an improved inherent fastener and system that allows the end-user to make changes to a sign message in a timelier and cost efficient manner, as will be described in greater detail herein. For these reasons the present inventor(s) provide a snap in place sign system (hereinafter referred to for convenience as "Snap N Place sign system") that has a fastener embedded in the sign substrate and therefore cannot get misplaced. The Snap N Place sign system can use different kinds of substrates (i.e., plastic or aluminum) and can be provided in a variety of sizes (i.e., room or cubical signs, nameplates, suite or conference room signs).

BRIEF SUMMARY

The following summary is provided to facilitate an understanding of some of the innovative features unique to the Snap N Place sign system and is not intended to be a full description. A full appreciation of the various aspects of the Snap N Place sign system as disclosed herein can be gained by taking the entire specification, claims, drawings, and abstract as a whole.

It is, therefore, one aspect of the disclosed features to provide for an imbedded fastener that will hold a sign lens to the substrate of the sign and allow for a message to be sandwiched in between the substrate and the lens.

It is another aspect of the disclosed features to provide for a timely and cost effective way in which to remove the sign lens in order to update the sign message.

The aforementioned aspects and other objectives and advantages can now be achieved as described herein. In accordance with features of the invention, the sign will include a sign substrate, the imbedded rubber nipple fastener and a sign lens. The sign substrate has calibrated counter-sunk holes drilled to allow the rubber nipple fasteners to lock in place by virtue of the size of the hole and pulling the rubber nipple fastener through each of the calibrated holes. The sign lens includes calibrated holes placed at the corners for securely holding the lens to the substrate via the rubber nipple fastener—this allows the lens to stay securely on but also allows for easy removal when desired.

To remove the sign lens, grip the middle of the lens on both sides with an index finger. Pull up gently. As the lens starts to flex, slide fingers to one edge of the plate and pull up slightly when you get to the rubber nipple fasteners. The lens will free itself from the rubber nipple fastener and the substrate of the sign. Repeat on the other side of the sign to remove the entire lens.

The sign message can be changed by printing on a transparency (found at any office supply store) and replaced by the end-user. Once the new message (with corresponding holes punched in the transparency) is in place, the lens can be put back in place by aligning the four holes in the lens with the four rubber nipple fasteners and pinching one of the rubber nipple fasteners and pulling up until the fastener stretches slightly. While the fastener is still stretched, push down on the edge of the lens and snap it down into position, thereby sandwiching the message in between the substrate and the lens.

It is another feature of the present invention that a size of the sign substrate and lens can vary to accommodate a different messages and needs (i.e. room signs, cubicle signs, or suite and conference room signs).

It is yet another feature of the present invention that the Snap N Place sign system allows a sign to be ADA compliant (Title III Regulations, 28 CFR, Ch. 1, Pt. 36, App. A, 4.30, revised Aug. 1, 1994).

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the disclosed features.

FIG. 8 illustrates how to change the message in a Snap N Place sign system, detailing steps to remove the lens, replace the sign message and place the lens back on the substrate, in accordance with the disclosed features.

DETAILED DESCRIPTION

The particular values and configurations discussed in these non-limiting examples can be varied and are cited merely to illustrate at least one embodiment and are not intended to limit the scope thereof.

Figure 1:
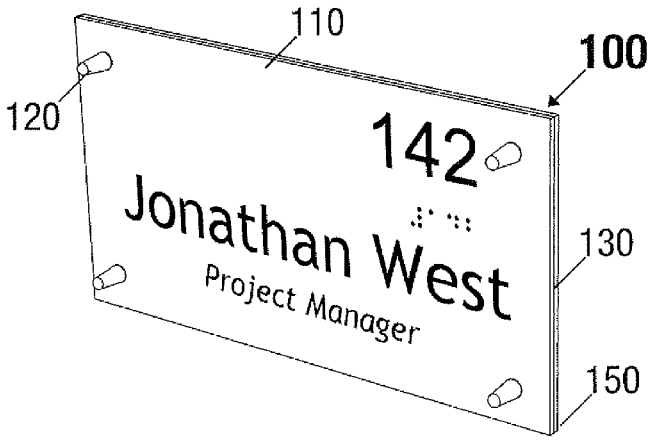
FIG. 1 illustrates a perspective view of a Snap N Place sign system, in accordance with the disclosed features.
Figure 2:
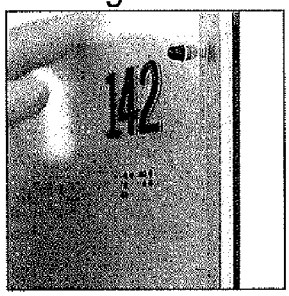
FIG. 2A pictorially illustrates the lens being removed from the sign substrate.
FIG. 2B pictorially illustrates the sign message being removed from the sign substrate.
FIG. 2C pictorially illustrates the back of the sign substrate, detailing the calibrated counter sunk area and hole drilled to allow the rubber nipple fastener to lock in place.
Figure 2:
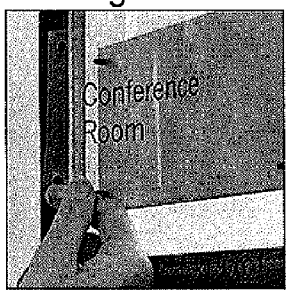
Figure 2:
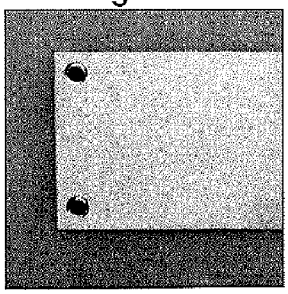

FIG. 1 illustrates a perspective view of a Snap N Place sign system 100, in accordance with the features. Note that in FIGS. 1-8, identical or similar blocks are generally indicated by identical reference numerals. The Snap N Place sign system 100 is simple and inexpensive to manufacture and requires little or no skill to change a sign message. The Snap N Place sign system 100 generally includes a sign substrate 150, a lens 110 and a number of rubber nipple fasteners 120 for securely holding a sign message 130 in between the sign substrate 150 and the lens 110. The lens 110 is preferably constructed of a clear pliable, durable engraving plastic such that the content of the sign message 130 is protected from physical damage. The Snap N Place sign system 100 can be made capable of holding various sign messages and the sign substrate 150 and lens 110 can be made in a variety of thicknesses and sizes.

Figure 3:
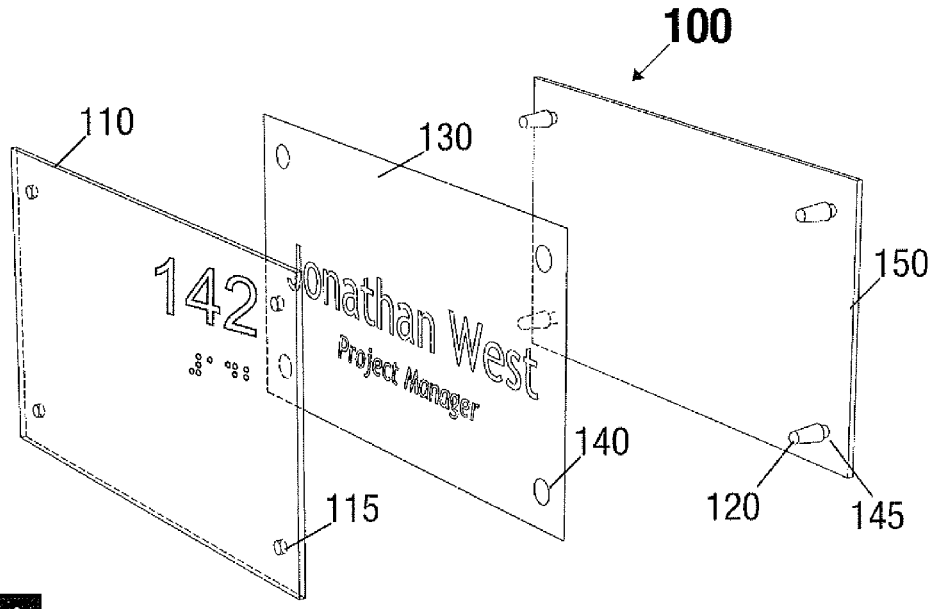
FIG. 3 illustrates an exploded perspective view and details the various components of the Snap N Place sign system, in accordance with the disclosed features.

FIG. 3 illustrates an exploded perspective view of the Snap N Place sign system 100, in accordance with the disclosed features. The Snap N Place sign system 100 further includes a sign substrate 150 associated with the rubber nipple fasteners 120, a sign message 130 and the lens 110. The sign message 130 can be typically made of clear transparency material but could also be made of paper, cardboard, or poster board. However, it should be appreciated that other materials or laminates thereof can also be utilized. The sign message 130 and the lens 110 include a number of mounting holes 140 and 115 placed at four corners for securely holding the sign message 130 in association with the sign substrate 150 utilizing the rubber nipple fastener 120. The rubber nipple fastener 120 can be pulled through the holes 115 in the lens 110 utilizing a relatively low insertion force. Although "rubber" is used herein to identify the rubber nipple fastener 120 described herein, it should be appreciated that the nipple faster can be made from flexible rubber-like material with properties like rubber, depending upon design considerations. Therefore, it should be appreciated that other types of materials may be utilized in place of the suggested material.

The mounting holes 140 on the sign message 130 align substantially with the holes 115 on the lens 110 so that the sign message 130 and the lens 110 may be secured to one another via the holes 140 and 115. Although both lens 110 and the sign substrate 150 are shown as being planar, in other features of the present invention these panels may be substantially concave or convex. The sign message 130 can be positioned between the sign substrate 150 and the lens 110. The sign message 130 may include a wide range of content, including, but not limited to, images, designs, photographs, text, or combinations thereof.

Figure 4:
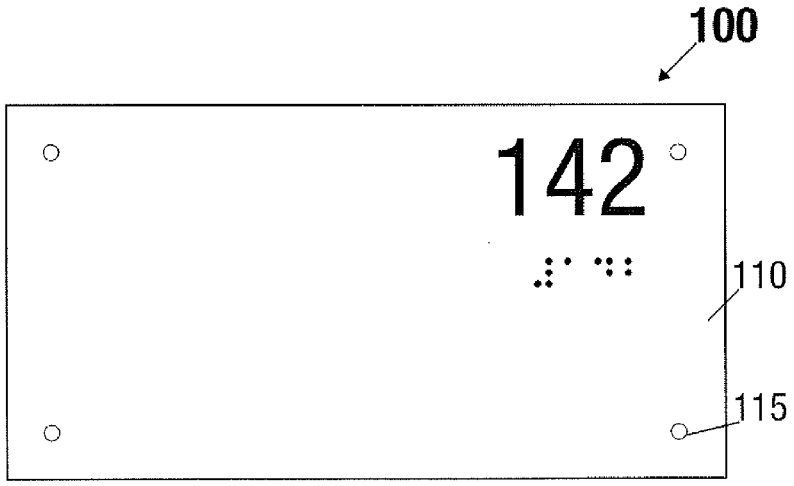
FIG. 4 illustrates a view of the lens used in the Snap N Place sign system, in accordance with the disclosed features.

FIG. 4 illustrates a view of the lens used in the Snap N Place sign system 100, in accordance with the disclosed features. The lens hole 115 allows the rubber nipple fastener 120 to be pulled through. The lens 110 can be made of pliable clear engraving plastic.

Figure 5:
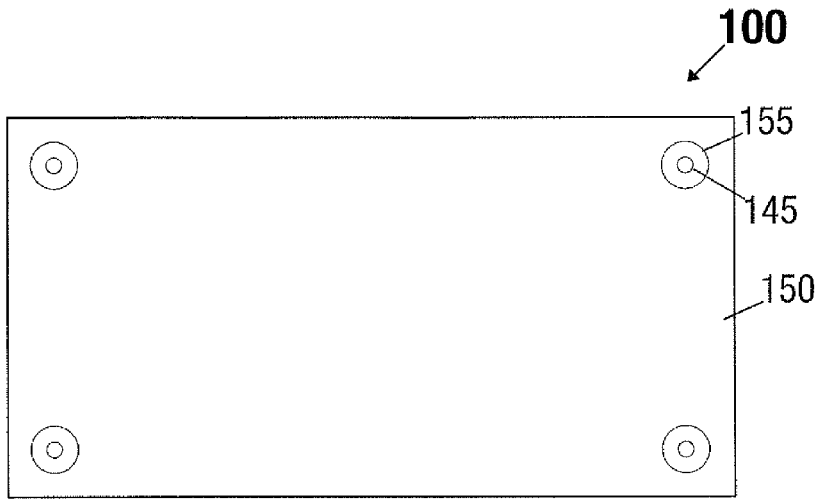
FIG. 5 illustrates the back of the sign substrate, detailing the calibrated counter sunk area and hole drilled to allow the rubber nipple fastener to lock in place.

FIG. 5 illustrates the back of the sign substrate 150, detailing the calibrated counter sunk area 155 which allows the rubber nipple fastener 120 to lock in place. The calibrated counter sunk area 155 has a depth that allows the rubber nipple faster enlarged head 160 to sit flush with the back of the sign substrate 150. The calibrated hole 145 drilled in the center of the calibrated counter sunk area 155 allows the rubber nipple fastener 120 to lock in place by virtue of the size of the hole 145.

Figure 6:
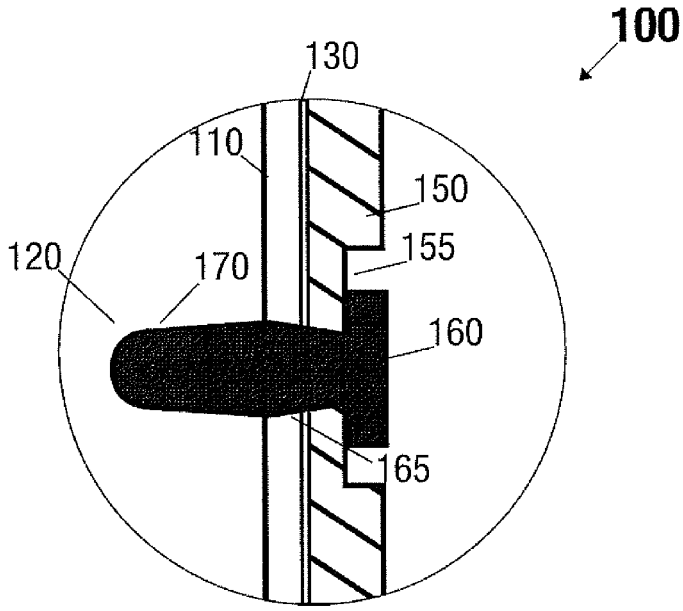
FIG. 6 illustrates a sectional side view of the Snap N Place sign system associated with the rubber nipple fastener, in accordance with features of the present invention.

FIG. 6 illustrates a sectional side view of the Snap N Place sign system 100 associated with the rubber nipple fastener 120 as it fits into the calibrated counter sunk area 155 and through the calibrated hole 145, in accordance with the disclosed features. The rubber nipple fasteners 120 of the present invention are preferably made of rubber depending upon design considerations, although it is conceivable that other materials will provide the flexibility of rubber and provide an equivalent functionality; therefore, rubber should be interpreted broadly to include such materials. It can be appreciated, however, that such features can be implemented in the context of other rubber nipple fasteners. The rubber nipple fastener 120 has features that include an enlarged head 160, an elongated tapered shank 165 and a flexible tab 170. The elongated tapered shank 165 of the rubber nipple fastener 120 associated with the sign substrate 150 fits tightly into the lens 110. Accordingly, the flexible tab 170 of the rubber nipple fastener 120 is pulled through the sign substrate hole 145, then through the sign message hole 140 and finally through the lens hole 115 providing a secure and stable means for securing the sign message 130, the lens 110 and the sign substrate 150 together.

Figure 7:
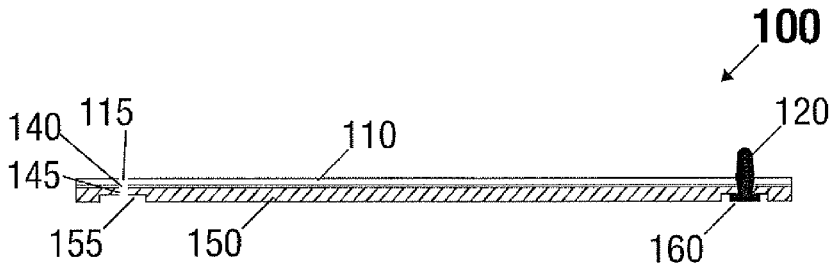
FIG. 7 illustrates an elevated view of the complete Snap N Place sign system.

FIG. 7 illustrates an elevated view of the complete Snap N Place sign system and each of its components. The sign message 130 can be placed on top of the sign substrate 150, matching the calibrated holes 145 and 140. Then the lens 110 can be placed on top of the sign message 130, aligning the calibrated holes 145, 140 and 115 together and pulling the rubber nipple fastener 120 through the hole 115, as depicted in FIG. 3.

FIG. 8 illustrates how to change the message in a Snap N Place sign system 300. To remove the sign message 130 (in order to change it), first the lens 110 must be removed by gripping the middle of the lens 110 on both sides with index figure and thumb. As the lens 110 starts to flex, slide finger to one edge of the lens 110 and pull up slightly when at the rubber nipple fastener 120. The lens 110 will free itself from the rubber nipple fastener 120, then repeat for any other rubber nipple fastener 120 locations. Remove current sign message 130 and replace with new sign message 130, aligning holes 140 to rubber nipple fastener 120 locations. Place lens 110 and align holes 115 to the rubber nipple fastener 120 locations. Pinch one of the rubber nipple fasteners 120 up until it stretches slightly. While the rubber nipple fastener 120 can be still stretched, push down on that edge of the lens 110, snapping the lens 110 into position. Repeat the same action to attach the lens 110 to any remaining rubble nipple fasteners 120, as illustrated in FIG. 7.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A Snap N Place sign system, comprising:

a sign substrate having a back surface and a front surface, the sign substrate including at least one hole formed through the sign substrate from its front surface to its back surface and a counter-sunk hole of a larger diameter than the at least one hole formed through the sign substrate that is formed partially into the back surface of the sign substrate in association with the hole formed through the sign substrate;

at least one rubber nipple fastener including an enlarged head, a tapered shank and a flexible tab, wherein the flexible tab serves as a nipple for the at least one rubber nipple fastener and has a diameter that is larger than the tapered shank and smaller than the enlarged head, wherein the at least on rubber fastener passes through the hole formed in the substrate from the tapered shank to the enlarged head, and wherein the enlarged head remains held in the counter-sunk hole and the tapered shank and the nipple passes through and protrudes from the front surface of the sign substrate;

a replaceable sign message having at least one mounting hole having at least a same diameter as a widest art of the enlarged head, wherein the at least one mounting hole accepts the nipple of the at least one rubber nipple fastener and the nipple is passed through the hole of the replaceable sign to thereby move the hole of the replaceable sign over the shank protruding from the front surface of the sign substrate; and a lens having at least one lens mounting hole of a smaller diameter than the nipple tab and at least of a same diameter of a widest part of the to tapered shank, wherein said at least one lens mounting hole accepts the nipple of the at least one rubber nipple fastener and the nipple is pulled through the hole of the lens to thereby move the hole of the lens over the shank protruding from the front surface of the sign substrate for securely holding the sign message against the surface of the sign substrate at the shank and beneath the nipple because of the nipple's larger diameter than the lens mounting hole.

2. The Snap N Place sign system of claim 1, wherein the lens is transparent.

3. The Snap N Place sign system of claim 1, wherein the lens is ADA compliant.

4. The Snap N Place sign system of claim 1, wherein the at least one rubber nipple fastener is passed through the at least one mounting hole associated with the sign message and pulled through the lens by the nipple utilizing a low insertion force such that the lens and the sign substrate are securely held together between the nipple and the front surface of the sign substrate.

5. A Snap N Place sign system, comprising:

a sign substrate associated with at least one rubber nipple fastener, wherein the sign has a back surface and a front surface and includes at least one hole formed therethrough from its front surface to its back surface and a counter-sunk hole of a larger diameter than the at least one hole formed through the sign substrate that is formed partially into the back surface of the sign substrate in association with the hole formed through the sign substrate, and the at least one rubber nipple fastener includes an enlarged head, a tapered shank and a flexible tab, wherein the flexible tab serves as a nipple for the at least one rubber nipple fastener and has a diameter that is larger than the tapered shank and smaller than the diameter of the enlarged head, wherein the at least one rubber fastener is pulled through the hole formed in the substrate from the tapered shank to the enlarged head, and wherein the enlarged head remains held in the counter-sunk hole and the tapered shank and the nipple protrudes from the front surface of the sign substrate at the tapered shank;

a replaceable sign message including front and back surfaces, the replaceable sign message having at least one mounting hole formed therein that is of at least the same diameter of the widest portion of the nipple for receiving the nipple and enabling the back surface of the sign message against the sign substrate; and a lens including front and back surfaces, said lens having at least one mounting hole formed therein of a smaller diameter than the diameter of the nipple, the at least one mounting hole for receiving the nipple and enabling the nipple to be pulled through the at least one mounting hole thereby securely holding the back surface of said lens against the front surface of said sign message beneath the nipple at the tapered shank because of the larger diameter of the nipple.

6. The Snap N Place sign system of claim 5, wherein the sign message is changed by gripping center of the lens on both edges and pulling the lens against the nipple in order to release the lens from the nipple of the at least one rubber nipple fastener.

7. The Snap N Place sign system of claim 5, wherein the lens is transparent.

8. The Snap N Place sign system of claim 5, wherein the lens ADA compliant.

9. A method for using a Snap N Place sign system, comprising:

providing a sign substrate having a front surface and a back surface and including at least one rubber nipple fastener further comprised of a rubber nipple and part of a tapered shank protruding from the front surface of the sign substrate, the rubber nipple having a larger diameter than the tapered shank;

placing a replaceable sign message having at least one mounting hole of a diameter at least as large as the widest diameter of the rubber nipple tab formed therein over the surface of the sign substrate and receiving the rubber nipple fastener through the at least one mounting hole formed in the replaceable sign message enabling the replaceable sign message to rest against the front surface of the sign substrate underneath the rubber nipple at the tapered shaft; and placing a lens having at least one mounting hole formed therein of a smaller diameter than a diameter of the rubber nipple tab and at least of a same diameter of a widest part of the to eyed shank over the replaceable sign message and pulling the rubber nipple fastener through the at least one mounting hole formed in the lens causing the lens to be held against the replaceable sign message and the replaceable sign message to be held against the front surface of the substrate underneath the rubber nipple at the tapered shaft because of the rubber nipple's lamer diameter.

10. The method for using a Snap N Place sign system of claim 9, wherein the at least one mounting hole permits holding and tool-free removal of the lens from the at least one rubber nipple fastener.

11. The method for using a Snap N Place sign system of claim 9, wherein said the message is changed by gripping center of the lens on both edges and pulling the lens in order to release the lens from the at least one rubber nipple fastener.

12. The method for using a Snap N Place sign system of claim 9, wherein the lens is transparent.

13. The method for using a Snap N Place sign system of claim 9, wherein the lens ADA compliant.

* * * * *